United States Patent [19]

Dirda

[11] 4,226,814

[45] Oct. 7, 1980

[54] CARBURETOR

[75] Inventor: John Dirda, Southfield, Mich.

[73] Assignee: Ford Motor Company, Dearborn, Mich.

[21] Appl. No.: 17,516

[22] Filed: Mar. 5, 1979

[51] Int. Cl.[3] ..... F02M 1/10

[52] U.S. Cl. ..... 261/39 B; 91/408; 91/395; 251/63.4; 251/78; 261/52

[58] Field of Search ..... 261/52, 39 B; 251/63.4, 251/78; 91/395, 408

[56] References Cited

U.S. PATENT DOCUMENTS

| | | | |
|---|---|---|---|
| 3,834,677 | 9/1974 | Hosho | 261/39 B |
| 3,872,847 | 3/1975 | Charron et al. | 261/39 B |
| 3,906,911 | 9/1975 | Nakada et al. | 261/52 |
| 3,962,379 | 6/1976 | Freismuth et al. | 261/52 |
| 3,962,380 | 6/1976 | Cedar et al. | 261/52 |
| 4,078,024 | 3/1978 | Bockelmann et al. | 261/39 B |
| 4,098,459 | 7/1978 | Benjamin | 261/39 B |
| 4,129,623 | 12/1978 | Rogerson et al. | 261/52 |

*Primary Examiner*—Tim R. Miles
*Attorney, Agent, or Firm*—Robert E. McCollum; Clifford L. Sadler

[57] ABSTRACT

An automotive type carburetor has a rotatable lever connected to the choke valve and to an actuating link having a pin-slot type connection to an engine vacuum controlled servo, a fast idle cam is connected to the choke lever by a lost motion pin and slot connection and to a second actuating link also connected to the servo by a pin-slot type connection, the servo pin-slot connections to the links are such that when the engine is started with the choke valve closed and the fast idle cam on its high cam step, vacuum applied to the servo during a first stage movement rotates the choke lever to open the choke valve and subsequently during a second stage movement both the choke lever is rotated further and the fast idle cam is rotated off its fast idle step position, to reduce the opening of the throttle valve while opening further the choke valve, the first stage movement of the servo moving a diaphragm and plunger until the plunger blocks a main vacuum feed line to the diaphragm, the second stage movement moving the diaphragm at a slower rate by applying vacuum to the diaphragm through a bypass passage bypassing the plunger, the bypass passage containing an adjustable needle valve.

9 Claims, 2 Drawing Figures

CARBURETOR

Figure 1:
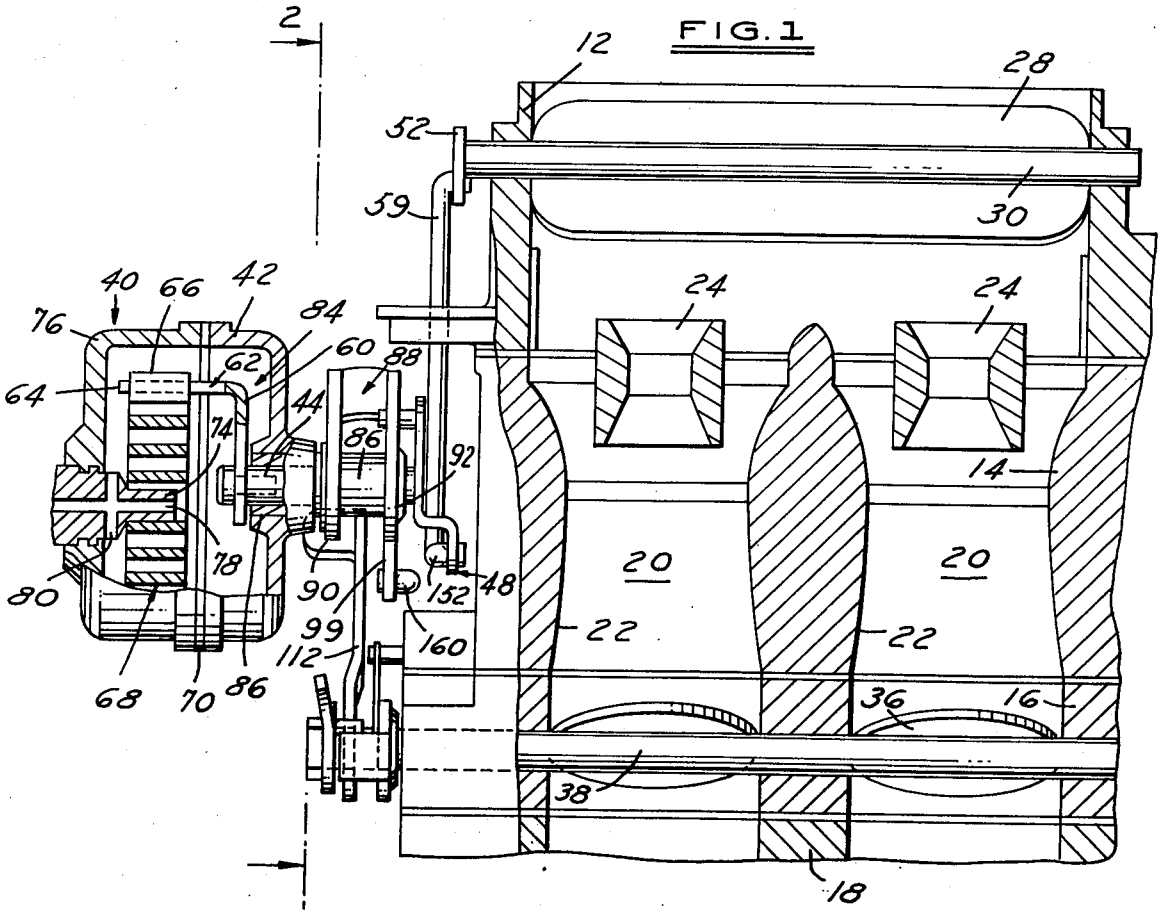

This invention relates in general to a motor vehicle type carburetor having a choke valve and a fast idle cam. More particularly, it relates to a construction for automatically opening the choke valve and rotating the fast idle cam to move the high idle cam step out of engagement with the throttle valve stop.

Most conventional carburetors have an automatic choke system for restricting air intake to richen the carburetor air/fuel mixture during cold engine operation to maintain good engine driveability. Also, in most instances, a fast idle cam that is operably rotated by a thermostatically responsive coiled spring is positioned in the path of closing movement of the throttle valve to maintain the throttle valve more open than the normal engine idle speed position to allow enough extra fuel-/air mixture into the engine to sustain cold engine operation. The thermostatic spring also urges the choke valve towards a closed position for engine starting, and immediately after the engine has reached a sustained operation, a pulldown servo cracks open the choke valve to a position leaning the air/fuel mixture to prevent rich mixture stalling.

In the above construction, an adjustable stop screw mounted on a lever secured to the throttle valve rotates into frictional engagement with a high idle step on the fast idle cam to determine the cold engine idle speed position of the throttle valve. Until the vehicle operator, therefore, manually opens the throttle valve to move the stop screw and release the cam, the cam cannot move from its position. Therefore, the throttle valve will remain in a high fast idle position with a higher than required engine speed as the engine begins to warm up. The normal procedure then is for the operator to depress the accelerator pedal to back off the idle screw from the high fast idle cam face and permit the cam to fall by gravity to whatever position is dictated by the particular temperature conditions. Subsequent release of the accelerator pedal then will reengage the fast idle screw with a lower idle step face of the cam and permit a closing down of the throttle valve.

It is a primary object of the invention to provide an apparatus for first automatically cracking open the choke valve to lean the rich starting air/fuel ratio, and subsequently automatically rotating the fast idle cam off its high idle cam step engagement with the throttle valve screw to decrease engine speed to a level more consistent with engine operational requirements while at the same time further opening the choke valve to lean the air/fuel mixture to a level more agreeable with the new throttle valve setting.

It is a further object of the invention to provide a carburetor of the type described above with a single vacuum servo mechanism actuated by engine manifold vacuum to first rotate a lever connected to the choke valve to crack open the valve, and then rotate the fast idle cam so that the high idle cam step will be moved out of engagement with the throttle valve idle adjustment stop screw and a second lower idle cam step of lesser radial extent will be rotated into engagement with the idle adjustment screw, while the lever connected to the choke valve is moved concurrently to move the choke valve to a more open position.

Devices are known for automatically cracking open the choke valve and subsequently automatically pulling the fast idle cam off the high idle cam step. For example, U.S. Pat. No. 3,962,379, Freismuth et al, "Carburetor Cold Enrichment System Having Automatic Choke Opener and Fast Idle Cam High Step Pull-Off Apparatus," shows a servo 86 that cracks open the choke valve a predetermined amount immediately after the engine is started. After a slight delay, vacuum is supplied to a second servo 198 that pulls the fast idle cam off the high cam step without the necessity of the operator removing his foot from the accelerator pedal. The choke valve is also opened further. It should be noted, however, that this particular mechanism just described requires the use of two separate servo mechanisms, one to first open the choke valve and a second one to move the fast idle cam from the high cam step position.

U.S. Pat. No. 3,962,380, Cedar et al., "Carburetor with Combined Choke Pull-Down and Fast Idle Cam Kick-Down Apparatus," also shows a mechanism for automatically opening the choke valve and rotating the fast idle cam off the high cam step. This particular mechanism utilizes a single vacuum controlled servo for accomplishing the two movements described. However, a double cam slide rail type mechanism is necessary to first push open the choke valve and subsequently rotate the fast idle cam to a different position, by a single continuous movement of the servo. Only a single movement of the choke lever is provided.

The invention combines the advantages of both of the above prior art devices in the use of only a single servo mechanism to both pull open the choke valve and subsequently rotate the fast idle cam off the high cam step while further rotating open the choke valve. The single servo per se provides the dual stage operation, the first stage being without delay, with the second stage being delayed to provide slow rotation of the fast idle cam and slow further opening of the choke valve. This invention is accomplished without the use of cam slide rail members as is shown in the U.S. Pat. No. 3,962,380 reference, for example.

Another object of the invention, therefore, is to provide a dual stage automatic choke valve pull-down mechanism and fast idle cam high step pull-off mechanism by the use of a single vacuum controlled servo having a dual stage operation.

It is another object of the invention to provide a mechanism of the type described above in which initial movement of the servo opens the choke valve a predetermined amount and continued movement of the servo slowly opens further and choke valve and simultaneously rotates the fast idle cam off the high cam step position.

It is a still further object of the invention to provide a servo of the type described above that includes a movable diaphragm member having control means to meter the flow of vacuum to the diaphragm to provide first a fast first stage of operation by applying the full value of vacuum to the diaphragm and secondly a slower second stage by delaying the application of vacuum to the diaphragm by controlling the flow past an adjustable metering means.

Figure 2:
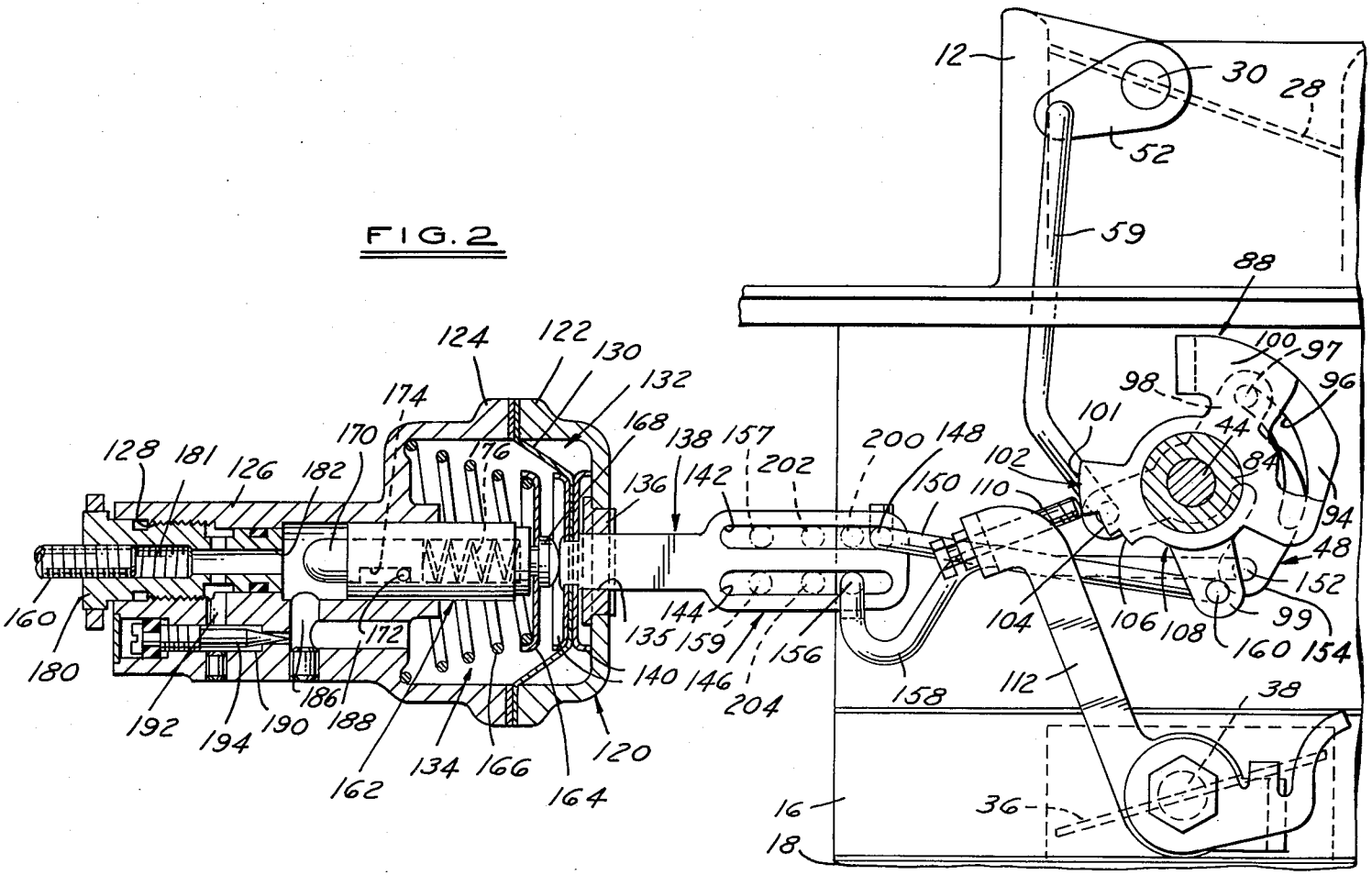

Other objects, features and advantages of the invention will become more apparent upon reference to the succeeding detailed description thereof, and to the drawings illustrating the preferred embodiment thereof; wherein, FIG. 1 is a side elevational view of a carburetor embodying the invention, with parts broken away and in section; and, FIG. 2 is a cross-sectional view on an enlarged scale taken on a plane indicated by and viewed in the direction of the arrows 2—2 of FIG. 1.

FIG. 1 is obtained by passing a plane through approximately one-half of a known type of two-barrel, downdraft carburetor. It includes an air horn section 12, a main body portion 14, and a throttle body 16 secured together by suitable means, not shown, over an intake manifold indicated partially at 18 leading to the engine combustion chambers.

Main body portion 14 contains the usual air/fuel mixture induction passages 20 having fresh air intakes at the air horn ends, and connected to manifold 18 at the opposite ends. The passages are each formed with a main venturi 22 in which is suitably mounted a boost venturi 24.

Air flow into passages 20 is controlled by a choke valve 28 that is unbalance mounted on a shaft 30. The shaft is rotatably mounted in side portions of the carburetor air horn, as shown. Flow of the usual fuel and air mixture through each passage 20 is controlled by a conventional throttle valve plate 36 fixed on a shaft 38 rotatably mounted in the throttle body 16. The throttle valves are rotated in the usual manner by depression of the vehicle accelerator pedal, and move from idle speed or closed positions to positions essentially at right angles to that shown.

Choke valve 28 rotates from the closed position shown to a nearly vertical, essentially inoperative position providing the minimum obstruction to airflow. The rotative position of choke valve 28 is controlled in part by a semiautomatically operating choke mechanism 40. The latter includes a hollow housing portion 42 that is cast as an integral extension of the carburetor throttle body 16. The housing is apertured for rotatably supporting one end of a choke valve control shaft 44. A bellcranktype lever 48 (see also FIG. 2) fixed on the opposite end portion of shaft 44 is pivotally connected by a link 59 to a lever 52 fixed on choke valve shaft 30. It will be clear that rotation of shaft 44 in either direction as seen in FIG. 2 will rotate choke valve 28 in a corresponding direction to open or close the carburetor air intake, as the case may be.

The end of shaft 44 in housing 42 has fixed on it one leg 60 of an essentially L-shaped thermostatic spring lever 62. The other lever leg portion 64 is secured to the end 66 of a thermostatically responsive, bimetallic coiled spring element 68 through an arcuate slot, not shown, in an insulating gasket 70. The inner end portion of the coiled spring is fixedly secured on the end of a nipple 74 formed as an integral portion of a choke cap 76 of heat insulating material. Nipple 74 is bored as shown to provide hot air passages 78 and 80 connected to an exhaust manifold heat stove, for example, by a tube, not shown. Cap 76 is secured to housing 42 by suitable means and defines an air or fluid chamber 84.

As thus far described, it will be clear that the thermostatic spring element 68 will contract or expand as a function of changes in temperature of the air entering from the hot air stove, or, if there is no flow, the ambient temperature of the air within chamber 84. Accordingly, changes in temperature will rotate the spring lever 62 to rotate shaft 44, lever 48, and choke valve 28 in one or the other directions, as the case may be.

Although not shown, chamber 84 would be connected by a passage to one of the carburetor main induction passages 20 by a port located just slightly below throttle valve 36 so that the chamber would, therefore, always be subject to the vacuum existing in the intake manifold passage portion 18. This causes the flow of hot air from the manifold stove to be pulled through the chamber 84.

The start of a cold engine requires a richer mixture than that of a warmed engine because less fuel is vaporized. Therefore, the choke valve must be shut or nearly shut to restrict air flow and increase the pressure drop across the fuel inlet to draw in more fuel and less air. The choke mechanism described above automatically accomplishes this action.

During cold engine operation, it is also necessary to open the throttle valve wider to allow enough extra air/fuel mixture into the engine to prevent it from stalling due to the extra friction, greater viscosity of the lubricant, etc. For this purpose, rotatably mounted on a sleeve bearing 86 supporting shaft 44 is an essentially conventional fast idle cam 88. The cam is essentially U-shaped, as seen in FIG. 1, with two legs 90 and 92. The longer leg 92 contains a counterweight portion 94 with a cam slot 96. The slot slidably receives a pin 97 that projects from an ear or tab 98 that extends from lever 48. Shorter leg 92 of cam 88 also has an eyed finger portion 99 adapted to be connected to a servo to be described. The shorter leg 90 of cam 88 is formed with a counterweighted portion 100 and also is formed with an arcuate edge 101. The edge has a number of circumferentially contiguous steps, including a high idle cam step 102 and a lower idle cam step 104. Each step in counterclockwise circumferential succession is defined by a face that is of less radial extent than the previous one, the lowest step 106 being followed by an offset or opening 108. The steps and opening constitute abutments or stops in the path movement of a stop screw 110 (FIG. 2). The screw is adjustably mounted on a lever 112 fixed on throttle shaft 38. The radial depth of opening 108 is chosen such that when the fast idle cam 88 is rotated to engage the screw 110 in the opening 108, the throttle valve shaft 38 will have rotated the throttle valve to its normal engine operating temperature level idle speed position essentially closing the induction passage. Engagement of the screw 110 with each of the steps 102 and 104 as the cam rotates upon temperature decreases then will progressively locate the idle speed position of the throttle valve at a more open position. The mass of the counterweights is chosen such that the cam will always fall by gravity in a counterclockwise direction, towards the position shown in FIG. 2.

As thus far described, it will be seen that the slot 96 and pin 97 constitute a lost motion connection so that choke lever 48 can rotate freely with respect to cam member 88 in a clockwise direction to open the choke valve. On the other hand, the fast idle cam is free to rotate in a clockwise direction towards lever 48, to set the same at the lower idle position. Therefore, when the temperature is low, the bimetallic coil 68 will rotate choke lever 48 counterclockwise, moving cam 88 in the same direction when the stop screw 110 is backed off from the cam face. When the temperature is warm, lever 48 will have rotated clockwise away from cam 88, permitting the cam to fall by gravity to an adjacent abutting position when the stop screw 110 is temporarily removed from the cam face.

Both lever 48 and cam 88 are adapted to be physically rotated by a servo 120.

More specifically, servo 120 is defined by a housing 122 having an enlarged hollow end portion 124 and a smaller diameter extension 126. The extension is provided with a throughbore 128 that opens into the hollow interior of the end portion 124. A fluid pressure actuated means in the form of an annular flexible diaphragm 130 is edge mounted in the end portion and partitions the end portion into an air chamber 132 and an engine vacuum or suction chamber 134. The air chamber is vented to ambient or atmospheric air through the end wall of housing 122 through an opening 135 in a guide member 136. The latter slidably receives the shaft of a an actuating rod 138 that is riveted as shown to diaphragm 130 by means of a pair of annular retainers or washers 140.

The actuating rod 138 has a pair of longitudinally extending aligned slots 142 and 144 formed in an enlarged end portion 146 of the rod. The slot 142 slidably receives therein the bent end 148 of an actuating lever or link 150, the other end 152 being pivotally mounted in the tab portion 154 extending from choke lever 48. The slot 144 slidably receives the bent end 156 of a curved actuating lever or link 158, the opposite end 160 being pivotally secured to the depending ear portion 99 of fast idle cam 88. It should be noted that the closed choke valve position of each of the actuating links 150 and 158 is as shown in FIG. 2. That is, end 148 is contiguous to the one end of slot 142 whereas end 156 of link 158 is spaced from the one end of slot 144, for a purpose to be described later. In the wide open choke valve position, the ends 148 and 156 of links 150 and 158 will be located at the dotted line positions 157 and 159 indicated.

The vacuum chamber 134 in servo housing 122 is connected to a vacuum tube 160 through the bore 128 of extension 126. The tube 160 is adapted to be connected to any suitable source of engine vacuum, such as, for example, at a location below the closed position of the throttle valve 36, so as to be subject to engine manifold vacuum changes at all times. Slidably mounted in bore 128 is a hollow control member 162 in the form of a stub shaft to which is secured a snap on type plate 164. The plate serves as a seat for a biasing spring 166 that normally pushes the stepped diameter button end 168 of the control member 162 against the rivet end of actuating rod 138 to locate the actuating rod as far to the right as possible, as seen in FIG. 2. This will permit the choke valve 28 to be in the closed choke valve position shown, and the fast idle cam to be in the high idle cam step location shown.

Mounted within the interior or recessed portion of control member or stub shaft 162 for a limited sliding movement relative to it is a plunger 170. A pin 172 secured to and projecting from the plunger moves within a recessed or cutout portion 174 of the control member to limit the axial outward projection of the plunger related to the control member. A spring 176 lightly loads the plunger outwardly to the position shown in FIG. 2.

The bore 128 threadedly receives a combination plunger and control member stop means or locator 180 that can be adjusted into or out of the bore to predetermine the travel of the plunger and control member. That is, the locator 180 has a central passage 181 that connects the vacuum in tube 160 to the bore 128 adjacent the plunger 170. The one end of passage 181 constitutes a seat 182 for the plunger 170 to seal off the vacuum passage at this point. Intersecting the passage 181 at the plunger seat 182 is a cross passage 186 joined to a passage 188 opening into the vacuum chamber 134. Also connected to passage 188 is a bypass passage 190 that intersects with a transverse passage 192 connected to passage 181. Flow of vacuum through the bypass passage 190 is controlled by an adjustably mounted needle valve 194.

In overall operation, assume that the engine is in an off condition and that the temperature is below normal engine operating level. The thermostatically responsive coil spring 68 will now yieldingly urge the choke lever 48 in a counterclockwise direction in an attempt to close the choke valve 28. This will also urge the fast idle cam 88 in the same direction by virtue of the connection between the pin 97 and cam slot 96. Therefore, when the vehicle operator depresses the throttle valve 36 to set the choke and fast idle cam, counterclockwise pivoting of the lever 112 and stop screw 110 away from the face or edge of the fast idle cam will permit the choke lever 48 to rotate to close the choke and rotate cam 88 to the position aligning the high idle cam step 102 with the throttle stop screw 110. In this position, the ends 148 and 156 of the actuating links 150 and 158 will be as shown in FIG. 2, the end 148 abutting the end of the slot 142 while the end 156 will be adjacent but spaced from the end of slot 144. The actuating rod 138 will be in the position shown by virtue of the force of servo locating spring 166. The plunger 170 will be spaced from the seal 182.

Assume now that the engine is cranked and a sustained operation is attained providing the normal running manifold vacuum level. This vacuum level is immediately communicated to the vacuum chamber 134 through the path of least resistance, i.e., tube 160, passage 181 and intersecting passages 186 and 188. This will move the diaphragm 130 and control member 162 leftwardly until the plunger 170 seats in the seat 182 of passage 181 thereby blocking further passage of vacuum to the intersecting passage 186. This constitutes the first stage of movement of the diaphragm 130 and actuating rod 138. At this time, therefore, leftward movement of the actuating rod 138 will immediately pull the connecting link 150 leftwardly to pivot the choke lever 48 clockwise and thereby open the choke valve 28 a predetermined amount, in this case 16°, for example. This will lean the rich air/fuel engine starting mixture to a more acceptable level. The leftward movement of actuating rod 138 will move the end 148 of link 150 to the dotted line position 200 by the time the plunger 170 seats. This position of end 148 of link 150 now corresponds to and is aligned with the position of the end 156 of connecting link 158. Therefore, further leftward movement of diaphragm 130 and actuating rod 138 will now move both links 150 and 158 simultaneously.

This continued leftward movement of the actuating rod 138 is obtained by the flow of vacuum from tube 160 through the bypass passage 192 and intersecting passage 190 past the needle valve 194 to passage 188 and chamber 134. This will move the control member 162 leftwardly until it seats against the end of locator 180. The plunger 170 permits this by moving into control member 162 collapsing spring 176. This will position the ends 148 and 156 of links 158 at approximately the dotted line positions 202, 204. This results in a simultaneous rotation of choke lever 48 to further open the choke valve 28 a predetermined amount, for example, an additional 15°, and a rotation of the fast idle cam 88 in a clockwise direction to move the high idle cam step 102 out of engagement with the stop screw 110 and move the lower idle cam face step 104 into engagement with the stop screw.

The needle valve 194 delays the application of vacuum to chamber 134 so that the second stage movement of actuating lever 138 will occur over an extended period when compared to the period of actuation during the first stage of operation. It will be clear, of course, that the delay or rate of second stage application of vacuum can be varied by screwing the needle valve in or out of the orifice 195 with which it cooperates.

Thus, it will be seen that the invention provides for an initial opening of the choke valve as soon as the engine is started and subsequently the fast idle cam is automatically rotated to move the high idle cam step out of engagement with the throttle stop screw while concurrently the choke valve is being opened further to more conform to the new setting of the throttle plates. It will also be seen that the invention accomplishes this all automatically in a dual stage mode by means of the single servo described and shown.

It will be clear that during starting of a warmed engine, the thermostatically responsive coiled spring 68 will have biased the choke lever 48 in a clockwise direction rotating away from the fast idle cam 88, which is engaged with the throttle valve stop screw 110. Therefore, as soon as the accelerator pedal is depressed to "set the fast idle cam", the stop screw will pivot away, and the fast idle cam will fall by gravity to whatever position is permitted by the position of choke lever 48, since the pin 97 is engaged in the arcuate slot 96.

While the invention has been shown and described in its preferred embodiment, it will be clear to those skilled in the arts to which it pertains that many changes and modifications may be made thereto without departing from the scope of the invention.

I claim:

1. A carburetor having a choke valve rotatable between closed and open positions, a rotatable choke pulldown lever connected to the choke valve for rotating the same, a throttle valve biased towards a closed position and rotatable between closed and open positions, a throttle lever operably fixed for rotation with the throttle valve and having a stop screw thereon, a rotatable fast idle cam having first and second circumferentially contiguous radial face type steps thereon of lessening radial extent adapted in first and second rotative positions of the cam, respectively, to project into the path of movement of the stop screw in a throttle valve closing direction to stop the throttle valve rotation in a different open position as a function of the step engaged by the stop screw, a first link connected to the pulldown lever for moving the pulldown lever to open the choke valve, a second link connected to the cam for rotating the cam to disengage the first cam step from the stop screw and engage the second cam step with the stop screw, a vacuum controlled servo, and control means connecting both the first and second links to the servo for controlled actuation of the pulldown lever and movement of the cam, the control means including an actuating rod reciprocable in opposite directions, the rod having a first elongated slot slidably receiving one end of the first link therein in a lost motion type manner, the rod having a second elongated slot slidably receiving therein one end of the second link in a lost motion type manner, the first link end abutting an end of the first slot when the choke valve is in a closed position, the second link end being spaced from the ends of the second slot when the choke valve is closed whereby actuation of the rod in one direction first moves the first link to open the choke valve and subsequently moves the second link to rotate the cam, the servo including a housing, a movable fluid pressure actuated diaphragm in the housing with the housing defining a vacuum chamber and an ambient air vent chamber, means connecting the diaphragm to the rod for movement thereof, spring means biasing the diaphragm and rod in a choke valve closing direction, conduit means connecting a source of engine vacuum to the vacuum chamber, and means to control the movement of the diaphragm to provide a dual stage movement of the rod including vacuum metering means to control the flow of vacuum to act on the diaphragm.

2. A carburetor as in claim 1, the vacuum metering means including blockage means movable in response to a predetermined movement of the diaphragm to block a portion of the conduit means to terminate a first stage movement of the diaphragm, the continued flow of vacuum through the remaining portion of the conduit means effecting a second stage movement of the diaphragm and rod, the first stage movement moving the first link and opening the choke valve, the fast idle cam being rotated during the second stage movement.

3. A carburetor as in claim 2, the blockage means including a control member operatively connected to the diaphragm and including a plunger slidably contained within the control member, one portion of the conduit means containing a seat, and spring means yieldably biasing the plunger outwardly of the control member, the application of vacuum to the piston moving the diaphragm and control member and plunger in the first stage movement a predetermined distance prior to the plunger engaging the seat and blocking the conduit means one portion, stop means in the path of movement of the control member, the continued application of vacuum to the diaphragm through the remaining portion of the conduit means moving the diaphragm and control member in the second stage movement a second predetermined distance until the control member abuts the stop means, the second stage movement collapsing the plunger against the spring means.

4. A carburetor as in claim 3, including means adjustably mounting the conduit means and stop means within the housing to vary the distance of travel of the plunger and control member and diaphragm before the attainment of the blocking position of the plunger against the seat and the attainment of the abutment position of the control member against the stop means.

5. A carburetor as in claim 3, the remaining portion of the conduit means comprising a bypass conduit, and flow rate control means in the bypass conduit to delay the application of vacuum to the diaphragm to provide a different rate of movement of the diaphragm during the second stage of movement than during the first stage of movement.

6. A carburetor as in claim 5, the flow rate control means comprising an adjustable needle valve adjustable to vary the flow rate through the bypass conduit.

7. A carburetor as in claim 1, the diaphragm consisting of an annular flexible diaphragm connected to the rod, the housing having a bore connected at one end to the source of vacuum and at its other end to the vacuum chamber, a stub shaft secured to the diaphragm and slidably mounted in the bore, a recess in the shaft, a plunger slidably mounted in the recess, spring means biasing the plunger to project outwardly of one end of the shaft, the bore having a first passage connected to the vacuum chamber around the shaft to control movement of the diaphragm and rod until movement of the diaphragm and shaft a predetermined distance seats the plunger against the seat to block flow of vacuum past the plunger, the conduit means having a second passage bypassing the blocked position of the plunger to connect vacuum to the vacuum chamber to provide a second stage movement of the diaphragm and shaft by collapsing of the spring means by movement of the plunger into the shaft recess, and stop means in the path of movement of the shaft when engaged by the shaft terminating the second stage movement of the diaphragm and rod.

8. A carburetor as in claim 7, the vacuum metering means including adjustable flow rate control means in the second passage to vary the rate of second stage movement of the diaphragm and actuating rod.

9. A carburetor as in claim 8, the flow rate control means including an adjustably mounted needle valve.

* * * * *